US005311565A

United States Patent [19]

Horikawa

[11] Patent Number: 5,311,565

[45] Date of Patent: May 10, 1994

[54] SOFT X-RAY MICROSCOPE

[75] Inventor: Yoshiaki Horikawa, Hachiouji, Japan

[73] Assignee: Olympus Optical Co., Ltd., Tokyo, Japan

[21] Appl. No.: 890,150

[22] Filed: May 29, 1992

[30] Foreign Application Priority Data

May 31, 1991 [JP] Japan ..... 3-129467

[51] Int. Cl.[5] ..... G21K 7/00

[52] U.S. Cl. ..... 378/43; 378/84

[58] Field of Search ..... 378/43, 84

[56] References Cited

FOREIGN PATENT DOCUMENTS 459833 12/1991 European Pat. Off. ..... 378/43

3179300 3/1991 Japan ..... 378/43

OTHER PUBLICATIONS

"X-Ray Microscopy With Synchrotron Radiation" Rudolph et al, Applied Physics vol. 15 #8, Aug. 1976, pp. 1883–1884.

Principles of Optics Title Page and Copyright Page—Max Born and Emil Wolf-1964.

X-Ray Optical Element and their Applications—Grazing Incidence Mirror 3.1-Partial Translation. Principles of Optics, pp. 526–533.

Fourier Imaging of Phase Information In Scanning and Conventional Optical Microscopes, pp. 513–517, by C. J. R. Shepparrd & T. Wilson.

Axisymmetric Grazing Incidence Optics for an X-Ray Microscopes and Microprobe S. Aoki, pp. 102–106.

A Zone Plate Soft X-Ray Microscope Using Undulator Radiation at the Photon Factory pp. 296–301 Y. Kagoshima et al.

*Primary Examiner*—Craig E. Church

*Attorney, Agent, or Firm*—Cushman, Darby & Cushman

[57] ABSTRACT

A soft X-ray microscope comprising a soft X-ray radiation source which is substantially a spot radiation source, a condenser for leading soft X-rays from the radiation source to a sample, a reflecting mirror for grazing incidence which is disposed between the radiation source and the condenser, and has a rough reflecting surface, an objective optical system for forming a magnified image of the sample, and a soft X-ray detector for receiving the soft X-rays from the objective optical system. This microscope exhibits excellent imaging characteristic even when it uses a spot radiation source.

9 Claims, 4 Drawing Sheets

SOFT X-RAY MICROSCOPE

BACKGROUND OF THE INVENTION a) Field of the Invention

The present invention relates to a soft X-ray microscope which is to be used for observing and measuring objects by utilizing soft X-rays having wavelengths within a range from several angstroms to several hundred angstroms.

b) Description of the Prior Art

The type of light sources for the conventional optical microscopes are halogen lamps, xenon lamps, mercury lamps and the like, which have light emitting members of finite sizes and emit incoherent rays diverging in all directions in space. Therefore, these light sources are generally used for illumination in Köhler mode since illumination in this mode can easily be performed by projecting an image of a light source 1 to a location at an infinite distance by a condenser 2 for illuminating a sample 3 as illustrated in FIG. 1.

The type of radiation sources for soft X-ray microscopes are X-ray sources of the conventional type which an electron beam, laser plasma radiation sources which utilize high-output pulse lasers developed one after another in the recent years and synchrotron radiation sources. Though the X-ray radiation sources of the type which an electron beam and the plasma radiation sources have radiation emitting members of finite sizes, they can hardly be used for illumination in the Köhler mode since the radiation sources use radiation emitting members which are very small (several microns to several hundred microns). Accordingly, the X-ray radiation sources are used generally for illumination in a critical mode wherein an image of a radiation source 4 is projected onto a sample 3 by using a condenser 2 as illustrated in FIG. 2. In the region of the soft X-rays, however, a zone plate utilizing diffraction or a reflecting mirror is used as the condenser. The radiation sources having radiation emitting members which are small but have directivities are usable for illumination in the Köhler mode (diverging in space), are actually used for illumination in the critical mode.

FIG. 3 illustrates a fundamental optical system for microscopes. In this drawing, the reference numeral 1 represents a radiation source, the reference numeral 2 designates a condenser, the reference numeral 3 denotes a sample, the reference numeral 6 represents an objective optical system and the reference numeral 7 designates an image surface. The optical system for microscopes illustrated in FIG. 3 can generally be regarded as a partially coherent optical system which has an imaging characteristic given in a form subjected to Fourier transformation as expressed by the formula (1) shown below (see Kogaku Gijutsu Handbook, p 118 and later, Asakura Shoten, Kogaku No Genri III, p 781 and later, Tokai Daigaku Shuppankai, etc.):

$$I(x,y) = \text{const.} \int\int\int_{-\infty}^{\infty}\int C(m,n;p,q)\, T(m,n)\, T^*(p,q) \times \exp[2\pi j\{(m-p)x + (n-q)y\}]\, dm\, dn\, dp\, dq \quad (1)$$

wherein the reference symbol I(x,y) represents brightness of image, the reference symbols x and y designate coordinates on an image surface, the reference symbols m, n, p and q denote spatial frequencies, the reference symbol j represents the imaginary unit, the reference symbol T designates transmittance distribution t of the sample subjected to Fourier transformation, the reference symbol T* denotes a complex conjugation of T and C(m,n;p,q) represents a transfer function of the partially coherent optical system expressed by the following formula (2):

$$C(m,n;p,q) = \int_{-\infty}^{\infty}\int |p_2(u,v)|^2\, p_1(u+m, v+n)\, p_1^*(v+p, v+q) \times du\, dv \quad (2)$$

wherein the reference symbol $p_1(u,v)$ represents a pupil function of the objective optical system, the reference symbol $p_2(u,v)$ designates a pupil function of the condenser, the reference symbols u and v denote coordinates on the pupil surface, m is equal to λfm expressed by using wavelength λ of radiation and the reference symbol f represents a focal length of the objective optical system.

The formula (1) mentioned above means that Fourier transformation is performed by multiplying the transmittance distribution t of the sample subjected to the Fourier transformation, i.e., a spatial frequency spectrum of the sample by C(m,n;p,q) which represents a frequency characteristic of a transfer function of the optical system. This means that a spot image response function of the optical system and an amplitude transmittance distribution of the sample are convoluted in real space.

The formula (2) mentioned above means that the transfer function C(m,n;p,q) is obtained by correlating the pupil function $P_2$ of the condenser to the pupil function $p_1$.

Let us consider the frequency characteristic of the optical system only in one direction for simplicity of description which will be made below for pointing out problems of microscopes using the radiation sources. When considered only in one direction, the formula (2) mentioned above gives a transfer function expressed by the following formula (3):

$$C(m,n) = \int_{-\infty}^{\infty} |p_2(u)|^2\, p_1(u+m)\, p_1^*(u+n)\, du \quad (3)$$

Let us assume that contrast is low on the sample or that a radiation bundle coming from the sample is scarcely scattered. It is already known that transmission of an image can be discussed in this case while considering a transfer function of C(m,o) (see, for example, Philos. Trans. R. Soc. London, A295 (1415) pp. 513 (1980)). In this case the formula (3) can be transformed as follows:

$$C(m,o) = \int_{-\infty}^{\infty} |p_2(u)|^2\, p_1(u+m)\, p_1^*(u)\, du \quad (4)$$

Though the formula (4) has an integration range of $-\infty$ to $+\infty$, this range is determined dependently on sizes of the optical system and the condenser since the pupil function has no value outside a range of a pupil. When the objective optical system has a pupil of a size traced as a circle in FIG. 4, the formula (4) has a value which corresponds to an area which is slashed in FIG. 4.

In case of an ordinary optical microscope, a light source has a large size 7 and a diameter of a light bundle to be allowed to be incident on the optical system thereof is determined dependently on an aperture of an aperture stop disposed before the condenser. The aperture of the aperture stop is ordinarily adjusted in conjunction with a numerical aperture of the objective optical system comprised in the microscope. Therefore, the light source is used for illumination in an incoherent mode, but the size of the condenser is equal to that of the pupil of the optical system in this case and let us represents a radius of these pupils by a reference symbol $a_1$. When the transfer function C(m,n) is traced on coordinates taking the spatial frequency as the abscissa, we obtain a curve A shown in FIG. 5. In this case, we obtain a cutoff frequency expressed as follows:

$$2a_1/(\lambda f)\ (=2NA/\lambda)$$

wherein the reference symbol NA represents a numerical aperture.

Further, size of the aperture of the aperture stop disposed before the condenser is often adjusted to 0.8 to 0.9 times as large as the numerical aperture of the objective optical system when contrast is low on the sample. This adjustment is performed for emphasizing locations at which the sample varies phases thereof by enhancing a degree of coherence of the illumination system and for facilitating observation of the sample by enhancing image contrast. In this case, the transfer function C(m,n) is represented by the curve B shown in FIG. 5 and the cutoff frequency is expressed as follows:

$$(a_1+a_2)/(\lambda f)$$

wherein the reference symbol $a_1$ represents a radius of the pupil of the objective optical system and the reference symbol $a_2$ designates a radius of the pupil of the condenser. In this case, it is difficult to quantitatively judge whether the image contrast represents variation of transmittance or phase of the sample.

Now, let us consider a case wherein the aperture of the aperture stop disposed before the condenser is extremely small. In this case, the radiation source is used as a spot source for illumination with a radiation. In this case, illumination is performed in a coherent mode and the transfer function C(m,n) is as represented by the curve C shown in FIG. 5. Then, the cutoff frequency is $a_1/(\lambda f)$ and has a value equal to half the value obtained by the incoherent illumination. Further, the degree of coherence of the illumination system becomes extremely high, whereby it is impossible to judge whether an image represents the variation of transmittance or the variation of phase.

When a microscope uses a radiation source or a coherent illumination system as described above, an image has high contrast but does not permit a microscopist to interpret the meaning of the image. In addition, such a radiation source poses a problem in that the resolving power of the microscope combined with the radiation source is lowered to approximately 50%. This problem has never been discussed by the prior art of which taught that light sources having light emitting members of finite sizes were to be used for microscopes.

Moreover, the point radiation sources such as the laser plasma radiation sources are used inevitably for illumination in the critical mode since these radiation sources cannot be effectively used for Köhler illumination. These radiation source provide illumination in an incoherent mode wherein the cutoff frequency is as represented by the curve A or B, but the critical illumination is problematic in that luminance distributions on radiation sources appear directly as illumination distributions on images.

SUMMARY OF THE INVENTION

In view of the problems described above, it is a primary object of the present invention to provide a soft X-ray microscope which exhibits excellent imaging characteristics even when it is combined with a spot light source such as a laser plasma light source or a radiation source.

The X-ray microscope according to the present invention comprises a soft X-ray radiation source which can be regarded substantially as a spot light source, a condenser for leading soft X-ray from the radiation source to a sample, an objective optical system for forming a magnified image of the sample and a soft X-ray detector for receiving soft X-rays from the objective optical system, and is characterized in that a grazing incidence mirror having a reflecting surface composed of a coarse surface is disposed between the soft X-ray radiation source and the condenser.

In the preferable formation of the present invention, the grazing incidence mirror is disposed at a location of a rear focal point of the condenser 7 and an aperture stop having a variable aperture is disposed on the incidence side of the grazing incidence mirror. Further, the reflecting surface of the grazing incidence mirror has roughness which is selected so as to be approximately equal, in a root of mean square thereof, to a wavelength of a radiation to be incident thereon.

This and other objects as well as the features and the advantages of the present invention will become apparent from the following detailed description of the preferred embodiments when taken in conjunction with the accompanying drawings.

DESCRIPTION OF THE PREFERRED EMBODIMENTS

Figure 1:
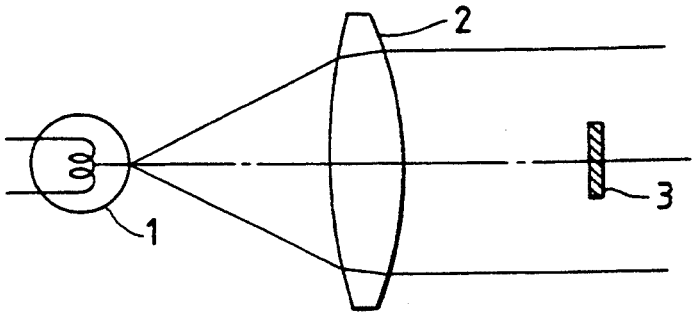
FIG. 1 PRIOR ART
FIG. 1 is a sectional view descriptive of illumination in the Köhler mode.
Figure 2:
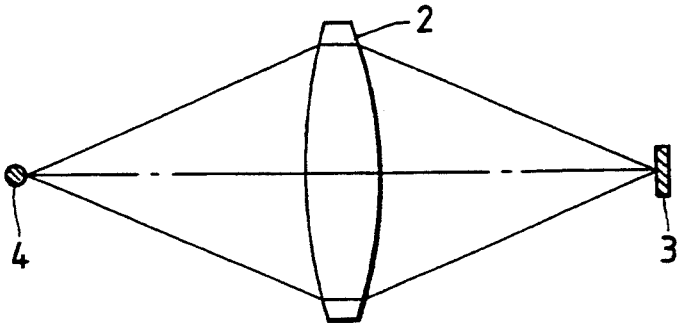
FIG. 2 PRIOR ART
FIG. 2 is a sectional view descriptive of illumination in the critical mode.
Figure 3:
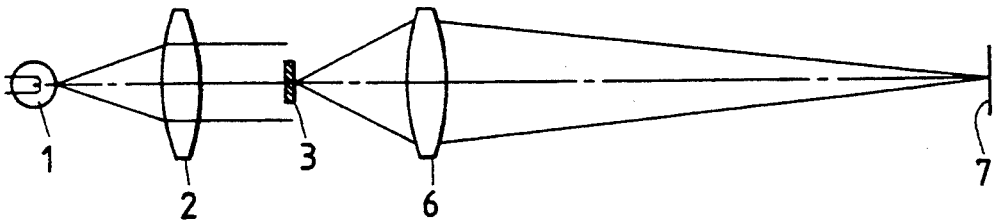
FIG. 3 PRIOR ART
FIG. 3 is a sectional view descriptive of a fundamental optical system for microscopes.
Figure 4:
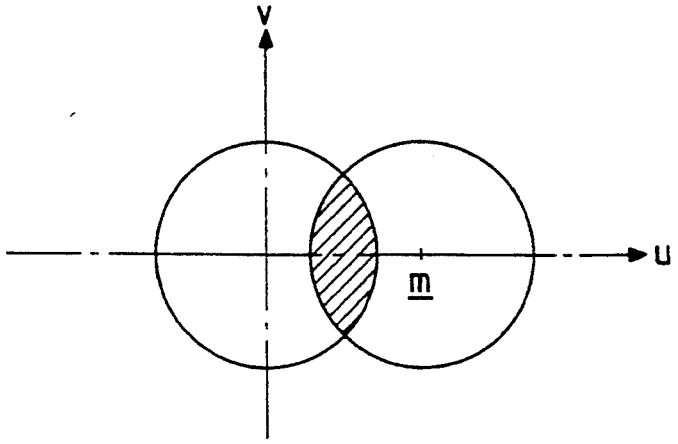
FIG. 4 PRIOR ART
FIG. 4 is a diagram descriptive of the integrating calculation by the formula (4)
Figure 5:
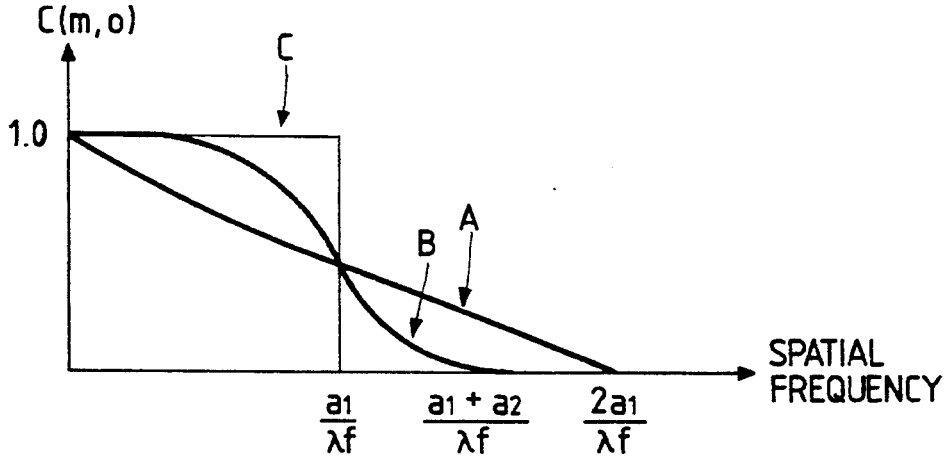
FIG. 5 PRIOR ART
FIG. 5 shows graphs illustrating relationship between the transfer function C(m,o) and frequency.
Figure 6:
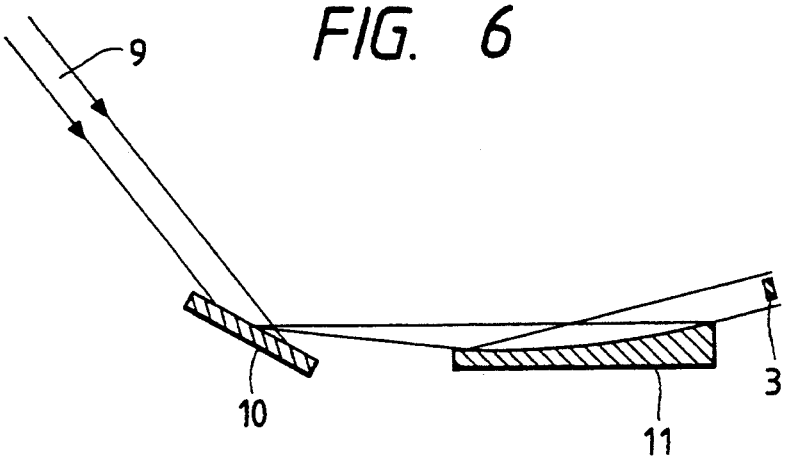
FIG. 6 is a sectional view descriptive of a fundamental means to be used for the X-ray microscope according to the present invention.

Prior to description the of the preferred embodiments, the principle of the present invention will be explained below with reference to FIG. 6. In FIG. 6, the reference numeral 3 represents a sample to be observed, the reference numeral 10 designates a reflecting mirror for grazing incidence having a rough surface and the reference numeral 11 denotes a condenser. A soft X-ray radiation bundle 9 emitted from a radiation source (not shown) is incident on the reflecting mirror for grazing incidence 10 and scattered by the surface of the mirror 10, whereby the reflecting surface of the reflecting mirror for grazing incidence 10 functions as a secondary incoherent radiation source. The radiation bundle scattered by the reflecting mirror for grazing incidence 10 is reflected by the condenser 11 and illuminates the sample to be observed 3. In this case, it is desirable that the reflecting mirror for grazing incidence 10 scatters the radiation bundle within a region of Mie scattering since intensity of the illuminating radiation is lowered when the reflecting mirror for grazing incidence 10 scatters the radiation bundle too much. For the scattering within the region on Mie region wherein loss of radiation intensity is little, it is desirable to select the roughness on the surface of the reflecting mirror for grazing incidence 10, i.e., the value of a root of mean square (RMS) of convexities and concavities on the surface, so as to be equal or larger to or than a wavelength of a radiation to be incident on the reflecting mirror. Further, it is known that the surface of the reflecting mirror for grazing incidence is to be polished so as to have the height of undulation h (a difference in height between vertices of the convexities and bottoms of the concavities) within a range defined below:

$$h<\lambda/(8 \sin \theta)$$

wherein the reference symbol $\theta$ represents an angle of grazing incidence (Applied Physics, vol. 56, No. 3, p 342 and later). When the angle of grazing incidence is 5°, the height of undulation h defined above is:

$$h<1.43 \lambda$$

and h in this case includes heights exceeding the wavelength of the incident radiation. However, h defined above applies to polishing precision of the reflecting surface and has no relation to the surface roughness.

Figure 7:
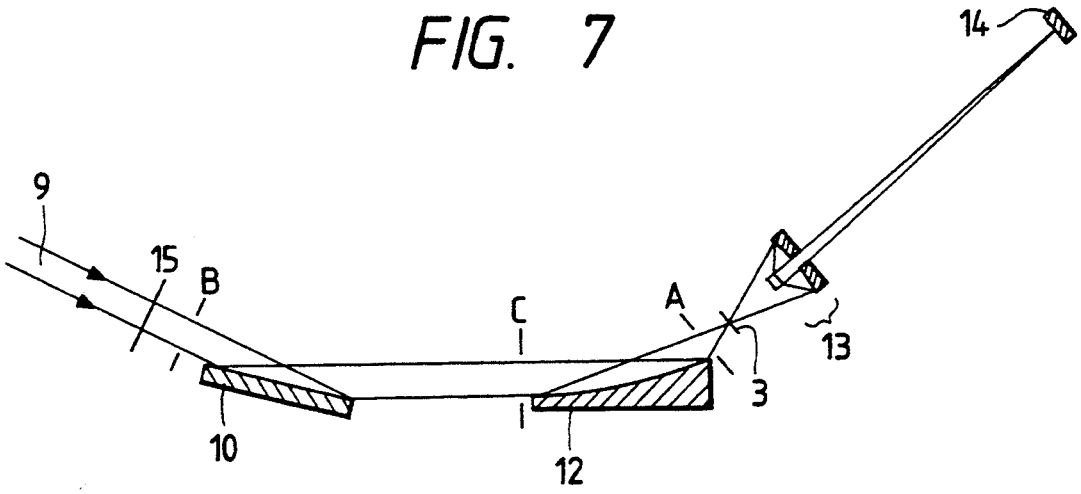
FIG. 7 is a sectional view descriptive of a first embodiment of the present invention using a radiation source.

FIG. 7 is a sectional view illustrating the first embodiment of the present invention. In FIG. 7 illustrating an optical system for microscope, the reference numeral 15 represents a filter which allows to pass therethrough only a component of 135 Å of radiation from the soft X-ray light bundle 9 emitted from the radiation source, and the reference numeral 10 designates a reflecting mirror for grazing incidence having a surface which is coated with molybdenum so as to have roughness of one hundred and several tens of angstroms, and disposed so that the radiation bundle having passed through the filter 15 will be incident thereon at a grazing angle of 14°. The reference numeral 12 denotes a condenser mirror which is designed as a reflecting mirror for grazing incidence consisting of a portion of paraboloid of revolution. For adjusting degree of coherence of an illumination system, disposed at a location of A, B or C shown in FIG. 7 is an aperture stop having a variable aperture. Further, the reference numeral 3 represents a sample to be observed, the reference numeral 13 designates a Schwarzschild type objective optical system for perpendicular incidence which is composed of reflecting mirrors consisting of multi-layer films and the reference numeral 14 denotes a micro-channel plate (MCP) for receiving soft X-rays having passed through the objective optical system 13. The illumination system is set in the critical illumination mode when the reflecting mirror for grazing incidence 10 is located at a position conjugate with the sample 3 with respect to the condenser mirror 12 or set in the Köhler illumination mode when the reflecting mirror 10 is located at the position of the rear focal point of the condenser mirror 12 in the optical system for microscopes having the configuration described above. In addition, the optical system for microscopes preferred as the first embodiment of the present invention adopts a radiation source.

A soft X-ray bundle 9 emitted from a radiation source (not shown) passes through the filter 15 and is incident on the reflecting mirror for grazing incidence 10, whereafter a radiation bundle scattered by the reflecting mirror 10 is incident on the condenser mirror 12. Therefore, the reflecting mirror for grazing incidence 10 can be regarded substantially as a radiation source for illuminating the sample. A soft X-ray bundle 9 which is condensed onto the sample 3 by the condenser mirror 12 is diffracted and the diffracted radiation is incident on the objective optical system for forming a magnified image of the sample 3 on the MCP 14. This image is photomultiplied by the MCP 14, converted into a visible image by a phosphor which is not shown and picked up by a high resolution television camera. In the first embodiment described above, the members disposed within a section from the radiation source to the phosphor are accommodated in a vacuum container.

Figure 8:
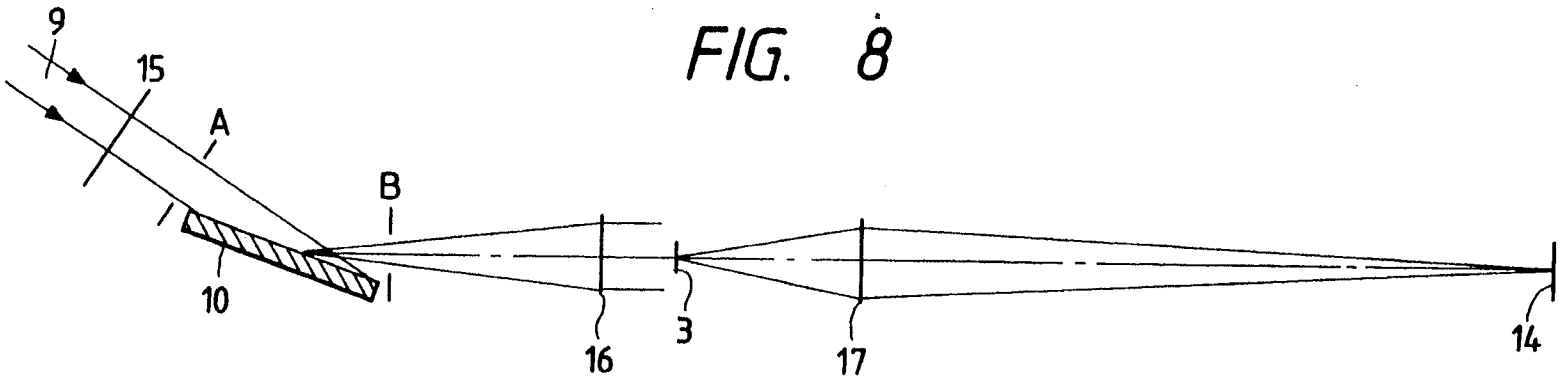
FIG. 8 is a sectional view descriptive of a second embodiment of the present invention using a radiation source.

FIG. 8 illustrates the second embodiment of the present invention. Used in the second embodiment are a condenser 16 consisting of a zone plate and an objective optical system 17 in place of the condenser mirror 12 and the Schwarzschild type objective optical system which are adopted in the first embodiment. The filter 15 has a property to selectively allow a component having a wavelength of 40 Å, out of the soft X-ray light bundle 9, to pass therethrough and the reflecting mirror for grazing incidence 10 has a surface which is coated with gold so as to have roughness of several ten angstroms matched with the wavelength of the radiation component to be incident thereon. The reflecting mirror for grazing incidence 10 is disposed so that the component of the soft X-ray bundle 9 having passed through the filter 15 will be incident at an angle of 2° on the reflecting surface 10. An aperture stop is disposed at a location indicated by A or B in FIG. 8. The second embodiment remains unchanged from the first embodiment with regard to the members which are not described in particular above.

Figure 9:
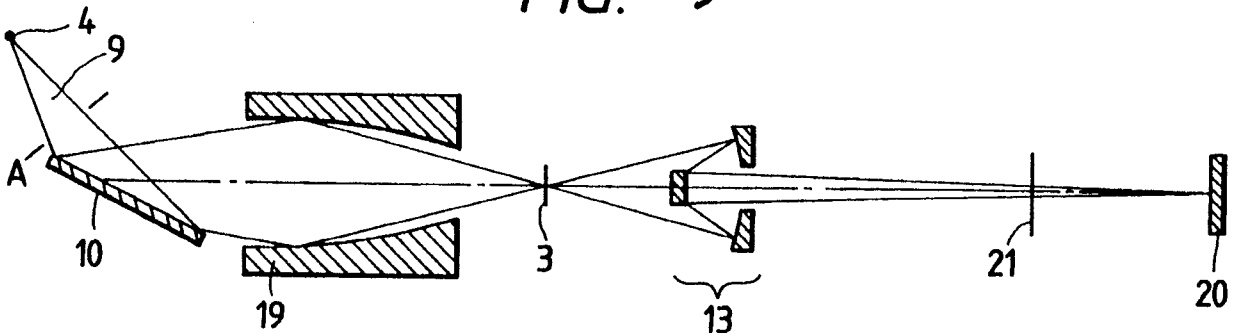
FIG. 9 is a sectional view descriptive of a third embodiment of the present invention using a laser plasma radiation source.

The third embodiment of the present invention is illustrated in FIG. 9, wherein the reference numeral 4 represents a laser plasma radiation source, the reference symbol A designates an aperture stop having a variable aperture, the reference numeral 10 denotes a reflecting mirror for grazing incidence having surface roughness of several ten angstroms and the reference numeral 19 represents a cylindrical condenser having a reflecting surface designed as a spheroid. Further, the reference numeral 13 represents a Schwarzschild type objective optical system composed of a reflecting mirror for perpendicular incidence which is composed of multi-layer films, the reference numeral 21 designates a filter which is composed of aluminium film several hundred angstroms thick and disposed for allowing transmission of soft X-rays while reflecting visible rays, and the reference numeral 20 denotes a solid-state image pickup device such as a CCD.

A radiation bundle 9 emitted from the radiation source 4 is scattered by the reflecting mirror for grazing incidence 10 and condensed onto the sample 3 by the condenser 19. The radiation bundle is diffracted by the sample 3 and incident on the objective optical system 13 for imaging onto the solid-state image pickup device 20. While the radiation bundle is passing through the filter 21, however, visible rays are eliminated so that only soft X-rays which are required for microscopy are incident on the solid-state image pickup device 20.

In the third embodiment, all the members of the optical system for microscopes are accommodated in a vacuum container. When it is required to place a sample to be observed in air, however, the illumination system and the observation system are to be accommodated in separate vacuum containers so that the sample can be placed in air in a space reserved between these two containers.

what is claimed is:

1. A soft X-ray microscope comprising:

a spot, soft X-ray radiation source for generating soft X-rays;

a condenser for directing said soft X-rays generated by said soft X-ray radiation source to a sample;

an objective optical system for receiving said soft X-rays from said sample and forming a magnified image of said sample;

a soft X-ray detector for receiving and detecting the soft X-rays from said objective optical system; and a grazing incidence mirror for reflecting said soft X-rays generated by said soft X-ray radiation source before the X-rays are directed by said condenser, the grazing incidence mirror having a rough reflecting surface with a sufficient roughness to diffuse the soft X-rays incident thereon wherein said roughness has an RMS value substantially equal to or larger than a wavelength of the soft x rays.

2. A soft X-ray microscope according to claim 1, wherein said soft X-ray radiation source is a synchrotron radiation source.

3. A soft X-ray microscope according to claim 2, wherein the roughness of the rough reflecting surface has an RMS of substantially the same value as a wavelength of the soft X-rays.

4. A soft X-ray microscope according to claim 1, wherein an aperture stop having a variable aperture is disposed on an incident side of said grazing incidence mirror.

5. A soft X-ray microscope according to claim 1, wherein said grazing incidence mirror is disposed at a position of a rear focal point of said condenser.

6. A soft X-ray microscope according to claim 1, wherein said soft X-ray radiation source is a laser plasma radiation source.

7. A soft X-ray microscope according to claim 1, wherein said rough reflecting surface is formed by applying a coating to said grazing incidence mirror.

8. A soft X-ray microscope according to claim 1, wherein said grazing incidence mirror is located at a position conjugate with respect to the sample and said condenser.

9. A soft X-ray microscope according to claim 1, wherein the grazing incidence mirror is disposed between the soft X-ray radiation source and the condenser.

* * * * *